US007821871B2

(12) United States Patent
Rohwedder

(10) Patent No.: US 7,821,871 B2
(45) Date of Patent: Oct. 26, 2010

(54) SWITCHING CIRCUIT FOR AN ELECTROMAGNETIC SOURCE FOR THE GENERATION OF ACOUSTIC WAVES

(75) Inventor: Arnim Rohwedder, Fürth (DE)

(73) Assignee: Siemens Aktiengesellschaft, Munich (DE)

( * ) Notice: Subject to any disclaimer, the term of this patent is extended or adjusted under 35 U.S.C. 154(b) by 1665 days.

(21) Appl. No.: 10/519,022

(22) PCT Filed: Jun. 16, 2003

(86) PCT No.: PCT/DE03/02017

§ 371 (c)(1),
(2), (4) Date: Dec. 22, 2004

(87) PCT Pub. No.: WO2004/002635

PCT Pub. Date: Jan. 8, 2004

(65) Prior Publication Data

US 2006/0152301 A1 Jul. 13, 2006

(30) Foreign Application Priority Data

Jun. 28, 2002 (DE) ..... 102 29 112

(51) Int. Cl.
*B06B 1/02* (2006.01)
*H01P 1/10* (2006.01)

(52) U.S. Cl. ..... 367/137

(58) Field of Classification Search ..... 367/137; 601/4

See application file for complete search history.

(56) References Cited

U.S. PATENT DOCUMENTS

| | | | | |
|---|---|---|---|---|
| 4,674,505 | A | 6/1987 | Pauli et al. | |
| 6,850,465 | B2 * | 2/2005 | Rohwedder | 367/137 |
| 2003/0161217 | A1 * | 8/2003 | Rohwedder | 367/142 |
| 2006/0152301 | A1 * | 7/2006 | Rohwedder | 333/105 |

FOREIGN PATENT DOCUMENTS

| | | |
|---|---|---|
| DE | 299 873 | 4/1913 |
| DE | 896 172 | 7/1949 |
| DE | 198 14 331 | 10/1999 |
| SU | 1 747 188 | 10/1990 |
| WO | WO 2004002635 A1 * | 1/2004 |

OTHER PUBLICATIONS

"Electromagnetische Erzeugung von Ebenen Druckstössen in Flüssigkeiten," Acustica, vol. 12, No. 1 (1962), pp. 185-201.

* cited by examiner

*Primary Examiner*—Dan Pihulic
(74) *Attorney, Agent, or Firm*—Schiff Hardin LLP

(57) ABSTRACT

A switching circuit for an electromagnetic source for generating acoustic waves has at least one first capacitor connected in parallel with a series circuit formed by a second capacitor and an electronic switch. The switching circuit is connected to a coil of the electromagnetic source, and the first and second capacitors are switched so as to both discharged into the coil, thereby supplying the coil with current.

14 Claims, 5 Drawing Sheets

SWITCHING CIRCUIT FOR AN ELECTROMAGNETIC SOURCE FOR THE GENERATION OF ACOUSTIC WAVES

BACKGROUND OF THE INVENTION

1. Field of the Invention

The present invention concerns a switching circuit for an electromagnetic source for the generation of acoustic waves of the type having a capacitor that is switched in parallel with at least one series circuit composed of another capacitor and a first diode.

2. Description of the Prior Art

A switching circuit for an electromagnetic pressure wave source of the above type is known from German OS 198 14 331. It has two LC oscillators connected in series. Of these, the first switching circuit has a first capacitor and, in parallel to this, a semiconductor power switch formed by a triggerable thyristor and a recovery diode switched antiparallel to the thyristor, as well as a subsequent inductance. Part of this first switching circuit, switched in series with the semiconductor power switch and the inductance, as well as parallel to the first capacitor, is a second capacitor that likewise belongs to the second switching circuit. Connected parallel to it is a saturable inductor and an electromagnetic pressure wave source fashioned as an inductive load. As soon as the thyristor of the semiconductor power switch has been triggered in the conductive state, the first capacitor charged with the capacitor charge device is connected to the second, initially uncharged capacitor, such that its charge passes into the second capacitor. The inductor and both capacitors are dimensioned such that the saturable inductor goes into saturation (and thus is of low inductance) only at the point in time when practically the same charge has been loaded from the first capacitor to the second capacitor. At this moment, due to the discharge voltage of the second capacitor with a time constant predetermined by the second switching circuit, a high discharge current flows through the inductive load of the electromagnetic pressure wave source, where an acoustic pulse is generated.

The switching circuit disclosed in Soviet Union 17 188 patent for the inductivity of an electrodynamic radiator has a common voltage source to which are connected a number of parallel branches with, respectively, one diode at the input, a storage capacitor connected to ground and an output-side commutator, i.e. switch. The diodes are thereby polarized such that the storage capacitors of the individual parallel branches always remain separated (i.e. unconnected) with regard to their charge voltages, such that transfer or transient effects of these charge voltages among one another are prevented. At the mutual discharging of storage caps, the commutators of all parallel branches are collectively, i.e. simultaneously, closed. During this discharging event, the storage capacitor of the respective branch is switched in parallel to its input-side diode.

A further switching circuit according to the prior art is shown in FIG. 1. The switching has a direct voltage source 1, a switch 2 that is normally executed as a discharger, a capacitor C as well as a coil L that is part of a sound generating unit of the electromagnetic source. In addition to the coil L, the acoustic wave generation unit of the electromagnetic source has a coil carrier (not shown) upon which the coil is arranged and an insulated membrane (likewise not shown) arranged on coil L. Upon the discharge of capacitor C via the coil L, a current i(t) flows through coil L, whereby an electromagnetic field is generated that interacts with the membrane. The membrane is thereby repelled in an acoustic propagation medium, whereby source pressure waves are emitted in the acoustic propagation medium as a carrier medium between the acoustic wave generation unit of the electromagnetic source and a subject to be acoustically irradiated. Shock waves can arise, for example, via non-linear effects in the carrier medium of the acoustic source pressure waves. The design of an electromagnetic source, especially of an electromagnetic shock wave source, is, for example, specified in European Application 0 133 665, corresponding to U.S. Pat. No. 4,674,505.

Shock waves are used, for example, for non-invasive destruction of calculi inside a patient, for instance for the destruction of a kidney stone. The shock waves directed at the kidney stone produce cracks in the kidney stone. The kidney stone finally breaks apart and can be excreted in a natural fashion.

If the switching circuit shown in FIG. 1 is operated for the generation of acoustic waves, during the discharge event of the capacitor C via the coil L (for which a short circuit is generated by means of the switch 2) the curves of the voltage u(t) (exemplarily plotted in FIG. 2) (curve 3) over the coil L and of the current i(t) (curve 4) result via the coil L. The decaying current i(t) flowing through the coil 4 is, as mentioned already, causes the generation of acoustic waves.

The acoustic waves generated by the electromagnetic shock wave source are proportional to the square of the current i(t) (curve 5 in FIG. 2). Subsequently originating from the discharge event of the capacitor C are a first acoustic source pressure wave from the first acoustic source pressure pulse (1st maximum) and further acoustic source pressure waves from the abating sequence of positive acoustic source pressure pulse. The first source pressure wave and the subsequent source pressure waves can, as mentioned already, form into shock waves with short, intensified positive portions and subsequently long, negative pressure troughs via non-linear effects in the carrier medium and a non-linear focusing which normally ensues with a known acoustic focusing lens.

Via the frequency of the current i(t) flowing through the coil L, characteristics of the shock wave (such as, for example, its focal radius) can be altered. With a variable current frequency, and thus a variable frequency of the shock wave, the size of the effective focus can, for example, be modified and adjusted to the subject to be treated dependent on the application. For instance, in a lithotripter the effective focus can be selected corresponding to the respective stone size, such that the acoustic energy is utilized better for the disintegration of the stone and the surrounding tissue is stressed less.

Due to the relatively high short circuit capacity up to the 100 MW range, a variable capacitance of the capacitor C and a variable inductance of coil L are costly. In order to vary the shock wave, in generally only the charge voltage of the capacitor C is therefore varied, whereby the maxima of the current i(t) changes via the coil L and the voltage u(t) to the coil L. However, the curve shapes of the current i(t) and the voltage u(t) remain essentially the same.

SUMMARY OF THE INVENTION

An object of the present invention is to provide a switching circuit of the type initially described wherein the generation of acoustic waves is improved.

According to the invention this object is achieved by a switching circuit of the previously cited type wherein the first switching component is switched such that, after the charging of both capacitors during the discharge of the first capacitor, it blocks as long, as the first capacitor is charged with a greater voltage than the second capacitor and is conductive as soon as the charge voltage of the initially discharged first capacitor achieves substantially the charge voltage of the second capacitor, whereby the second capacitor begins to discharge and both discharging capacitors feed the coil of the electromagnetic source with current.

The invention furthermore concerns an electromagnetic source with an inventive switching circuit as well as a lithotripter with such an electromagnetic source.

The first switching component (that, according to a preferred embodiment of the invention, is a first diode or a first diode module) is switched such that it blocks after the charging of both capacitors, thus preventing transient effects between both capacitors. In a preferred variant of the invention, the first capacitor can be charged with a greater charge voltage than the second capacitor prior to the discharge of both capacitors. For the generation of the acoustic wave by the electric circuit, the discharge of the first capacitor, thus with the capacitor with the greater charge voltage, is first begun via the coil of the electromagnetic source. As soon as the charge voltage of the first capacitor is substantially equal to the charge voltage of the second capacitor, the first switching component becomes conductive, so that both capacitors discharge and both capacitors feed the coil of the electromagnetic source with current. Consequently the switching circuit has the capacity of the first capacitor before the second capacitor begins to discharge. While both capacitors discharge, the switching circuit has a capacitance that corresponds to the sum of the capacitances of both capacitors. Thus a temporally variable capacitance of the circuit arises, whereby the curve form of the current flowing through the coil of the electromagnetic source can be influenced. By a variation of the charge voltages of both capacitors, the curve form of the current can thus be modified by the coil, and in turn the properties of the shockwave of the electromagnetic source can be varied. The curve form of the discharge current can be further varied when the switching circuit has a number of switching component capacitor pairs switched in series that are switched in parallel to the first capacitor and are charged with different charge voltages.

The first diode module can be formed, for example, as a series circuit and/or a parallel circuit of a number of diodes.

According to an embodiment of the invention, prior to the discharge the first capacitor can be charged with a first direct voltage source and the second capacitor can be charged with a second direct voltage source. According to a preferred embodiment of the invention, the first capacitor and the second capacitor are charged with only one direct voltage source, and the direct voltage source is disconnected from the second capacitor with a switching element as soon as the second capacitor has achieved its charge voltage. According to an embodiment of the invention, the switching element is at least one semiconductor element.

According to a preferred embodiment of the invention, the parallel circuit composed of the second capacitor/first switching component and first capacitor is switched in parallel to with a second switching component. According to an embodiment of the invention, the second switching component is a second diode or a second diode module.

A temporal extension of the first source pressure pulse is achieved by the parallel connection of the second switching component to the capacitors given the discharge. Moreover, the subsequently decaying source pressure pulses dependent on the impedance of the second switching component are significantly damped. The damping can be so great that the subsequent source pressure pulses disappear entirely. Via the temporal extension of the first source pressure pulse, a stronger first acoustic wave (thus a stronger first shock wave) is generated, and an amplification of the volume results in an improved effect for the disintegration of calculi. Since only a few weak source pressure pulses, or even no source pressure pulses at all, occur subsequent to the first source pressure pulse, the tissue-damaging cavitation caused by shockwaves from the subsequent source pressure pulses and following the first shockwave is prevented. The lifespan of the first and the second capacitors is thereby increased by the conditionally reverse voltage reduced dependent on the second switching component. In addition, given such a generation of shock waves less audible sound waves are produced, so that a noise reduction results. The total area under the curve of the current is a determining factor in the generation of audible sound waves during the generation of shock waves. In the case of the present invention, this is reduced overall by the omission of the source pressure pulse normally following the first source pressure pulse.

DESCRIPTION OF THE PREFERRED EMBODIMENTS

Figure 1:
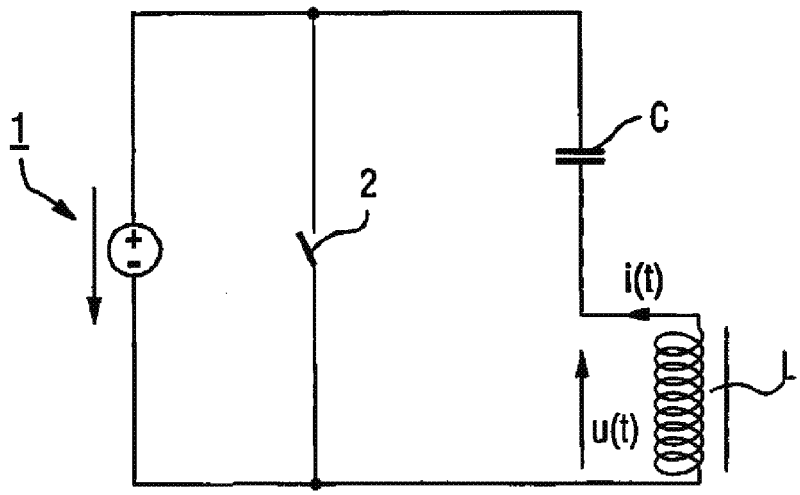
FIG 1 (PRIOR ART)
FIG. 1 illustrates a known switching circuit for generation of acoustic waves.
Figure 2:
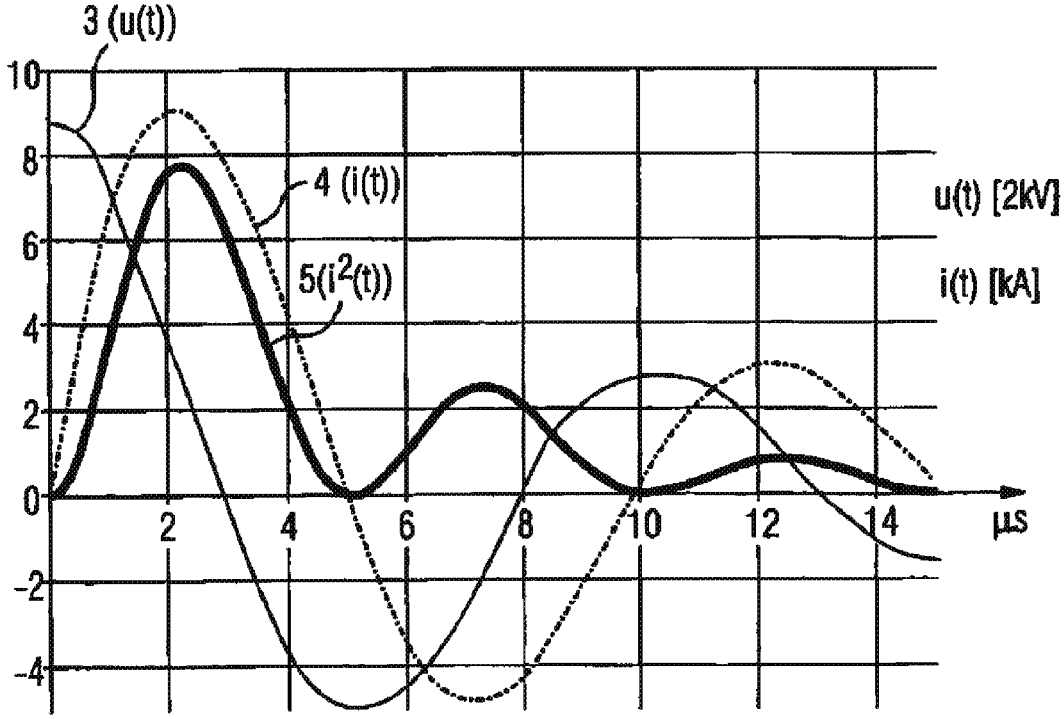
FIG. 2 illustrates the curve of the voltage u(t), the current l(t) and the square of the current $i^2(t)$ over time during the discharge of the capacitors of the switching circuit of FIG. 1.
Figure 3:
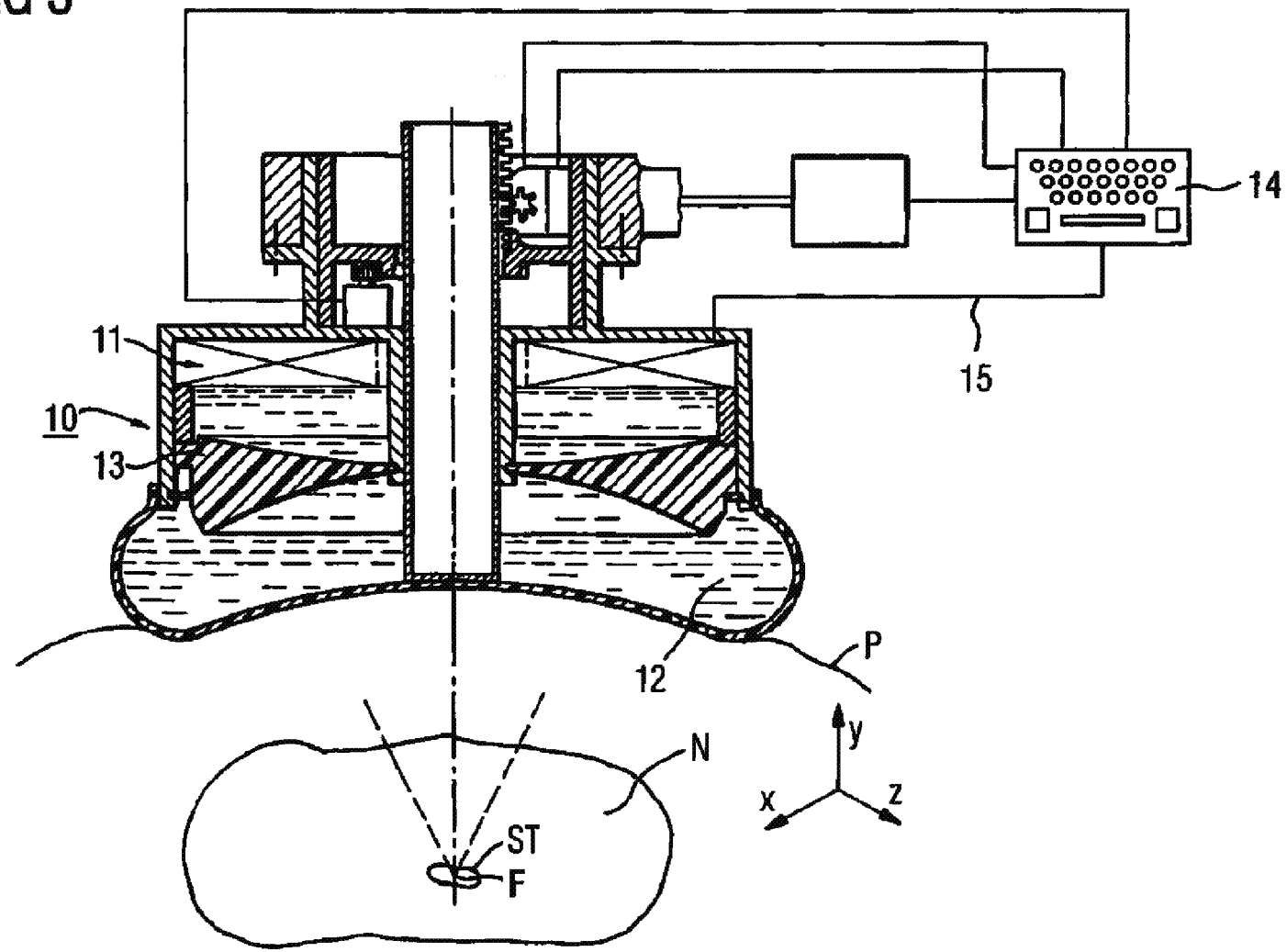
FIG. 3 schematically illustrates an electromagnetic shockwave source.

Partly in section and party in the form of a block diagram, FIG. 3 shows an electromagnetic shockwave source in the form of a therapy head 10 that, in the exemplary embodiment, is a component of a lithotripter (not shown in detail). The therapy head 10 has a known sound generation unit (designated with 11) that operates according to the electromagnetic principle. In FIG. 3, the sound generation unit 11 has (in a manner not shown) a coil carrier, a flat coil arranged thereon and a metallic membrane insulated from the flat coil. To generate shockwaves, the membrane is repelled in an acoustic propagation medium 12 by electromagnetic interaction with the flat coil, whereby a source pressure wave is emitted into the propagation medium. The source pressure wave of the acoustic lens 13 is focused on a focus zone F, whereby the source pressure wave is intensified into a shockwave during its propagation in the acoustic propagation medium 12 and after introduction into the body of a patient P. In the exemplary embodiment shown in FIG. 3, the shockwave serves to disintegrate a stone ST in the kidney N of the patient P.

Figure 4:
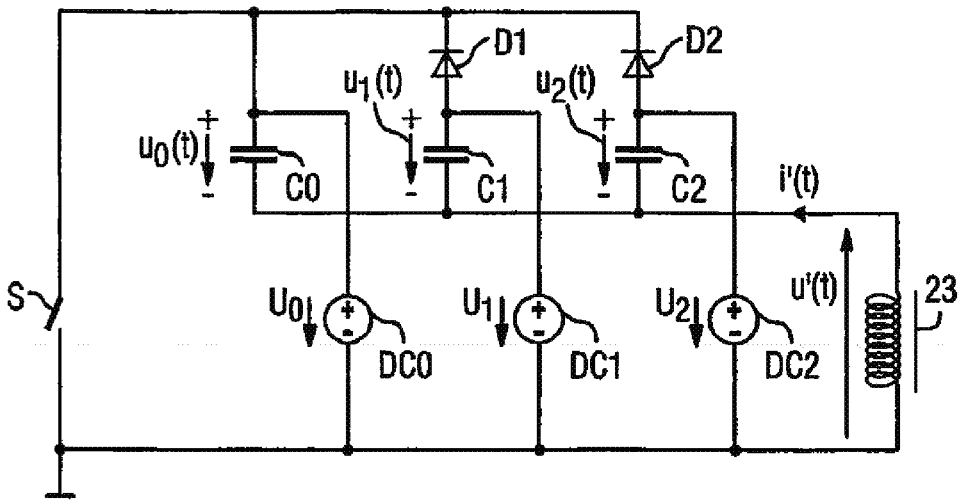
FIG. 4 shows an inventive switching circuit for generation of acoustic waves.

The therapy head 10 is allocated to an operation and care unit 14 that, except for the flat coil, has the inventive switching circuit shown in FIG. 4 for generation of acoustic waves. The operation and care unit 14 is electrically connected with the sound generation unit 11 via a connection line 15 shown in FIG. 3.

The inventive switching circuit shown in FIG. 4 for an electromagnetic shockwave source for generation of acoustic waves has direct voltage sources DC0, DC1 and DC2, a switching means S, capacitors C0, C1 and C2 and the flat coil 23 of the electromagnetic sound generation unit 11 of the therapy head 10. In the exemplary embodiment, a diode D1 is switched in series with the capacitor C1 and a diode D2 is switched in series with the capacitor C2. The series switching circuits made from capacitor C1/diode D1 and capacitor C2/diode D2 are moreover switched parallel to the capacitor C0.

For charging the capacitors C0 through C2, the switching element S is opened. The capacitor C0 is therefore charged with the direct voltage $U_0$ of the direct voltage source DC0 and the polarity shown in FIG. 4. The capacitor C1 is charged with the direct voltage $U_1$ of the direct voltage source DC1 and the polarity shown in FIG. 4. In the exemplary embodiment, the voltage $U_1$ of the direct voltage source DC1 is smaller than the voltage $U_0$ of the direct voltage source DC0. The diode D1 is switched such that it blocks as long as the capacitor C0 is charged with a greater voltage $u_0(t)$ than the capacitor C1. The diode D1 thus prevents a transient effect between the capacitors C0 and C1 charged with the voltages $U_0$ or $U_1$, which is why, at the end of the charging, the capacitor C0 is charged with the higher voltage $U_0$ than the capacitor C1, which is charged with the voltage $U_1$ at the end of the charging. The capacitor C2 is furthermore charged with the direct voltage $U_2$ of the direct voltage source DC2 and the polarity shown in FIG. 4. In the exemplary embodiment, the direct voltage $U_2$ is smaller than the direct voltage $U_1$. The diode D2 is likewise switched such that it blocks as long as the voltage $u_2(t)$ of the capacitor C2 is smaller than the voltage $u_0(t)$ of the capacitor C0. It is thus possible to charge the capacitors C0 through C2 with voltages of different sizes.

For the generation of the shockwaves, the switching element S is closed. The capacitor C0 begins to discharge via the coil 23, whereby the voltage $u_0(t)$ of the capacitor C) sinks and a current i'(t) flows through the flat coil 23. The voltage applied to the flat coil 23 is designated with u'(t). If the voltage $u_0(t)$ of the capacitor C0 achieves the value of the voltage $U_1$ of the charged capacitor C1, the diode D1 is conductive and the current i'(t) through the flat coil 23 is fed by both capacitors C0 and C1. If the voltage $u_0(t)$ of the capacitor C0 and the voltage $u_1(t)$ of the capacitor C1 achieve the voltage $U_2$ of the charged capacitor C2, the diode D2 is conductive and the current i'(t) through the flat coil 23 is fed by the three capacitors C0 through C2. This thus represents a temporally variable capacitance of the switching circuit, whereby the curve shape of the current i'(t) flowing through the flat coil 23 can be influenced. By further combinations (not shown in FIG. 4) of capacitors/diodes switched in parallel with the capacitor C0, the capacitors of which combinations being charged with voltages of different amounts that are less than the voltage $U_0$ of the direct voltage source DC0, the curve shape of the current i'(t) can be further influenced by the flat coil 23 during the discharge.

Figure 5:
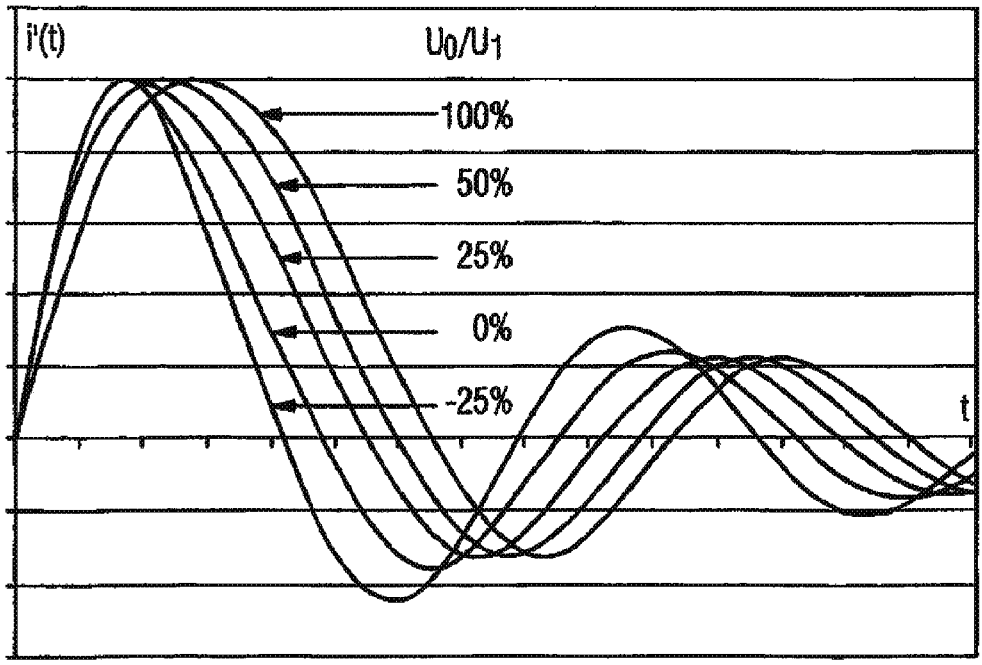
FIG. 5 illustrates the curve of the current i'(t) over time during the discharge of the inventive switching circuit.

As an example, FIG. 5 shows curves of currents i'(t) through the flat coil 23 during the discharge, when the switching circuit shown in FIG. 4 comprises only the capacitors C0 and C1. By a suitable selection of the voltages $U_0$ and $U_1$ of the direct voltage sources DC0 and DC1, the current maxima have equal values.

Figure 6:
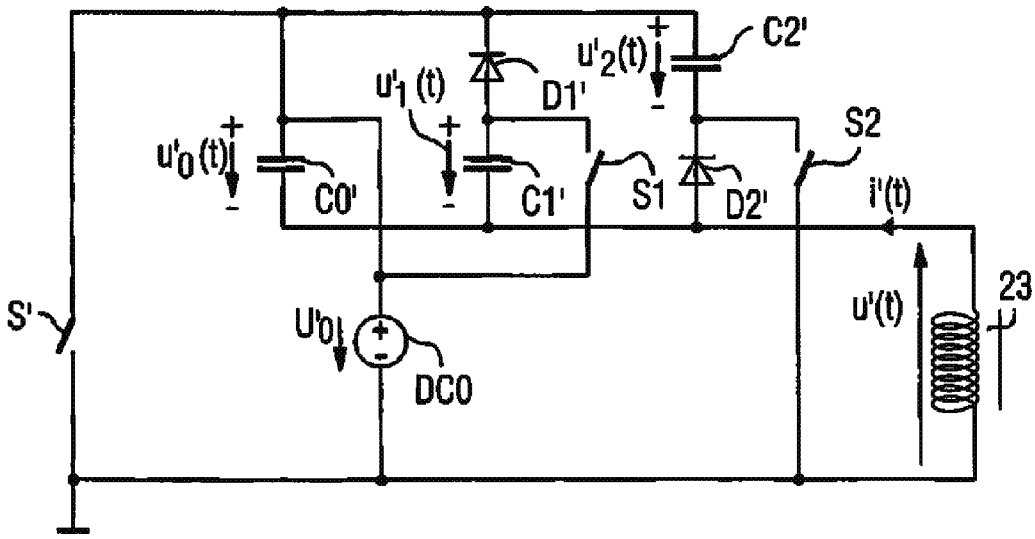
FIGS. 6 through 8 respectively show further embodiments of the inventive switching circuit.

FIG. 6 shows a further embodiment of an inventive switching circuit. In the exemplary embodiment, the switching circuit shown in FIG. 6 comprises capacitors C0' through C2', switching elements S', S1 and S2, diodes D1' and D2', a direct voltage source DC0' and the flat coil 23.

The diode D1' and the capacitor C1' as well as the diode D2' and the capacitor C2' are switched in series. The series switching circuits made from capacitor C1'/diode D1' and capacitor C2'/diode D2' are switched parallel to the capacitor C0'. The diodes D1' and D2' are polarized such that they block as long as the capacitor C0' is charged with a voltage $u_0'(t)$ according to the polarity indicated in FIG. 6, which is greater than the voltage $u_1'(t)$ of the capacitor C1' or the voltage $u_2'(t)$ of the capacitor C2' according to the indicated polarity.

During the charging of the capacitors C0' through C2', the switching element S' is opened. At the beginning of the charging, the switches S1 and S2 are closed. Since the capacitors C1' and C2' should be charged with charging voltages $U_1'$ and $U_2'$, which are smaller than the voltage $U_0'$ of the direct voltage DC0', the switches S1 and S2 are opened when the capacitors C1' and C2' are charged with the desired voltages $U_1'$ and $U_2'$. Since, in the case of the present exemplary embodiment, the capacitors are charged with relatively low currents (less than 1 ampere), switching precisions of the switches S1 and S2 in the millisecond range are sufficient in order to charge the capacitors C1' and C2' with sufficient precision. The voltages $u_1'(t)$ and $u_2'(t)$ of the capacitors C1' and C2' are monitored with measurement devices (not shown in FIG. 6) during the charging.

At the end of the charging, the switching elements S1 and S2 are therefore open, the capacitor C0[ is charged with the voltage $U_0'$ of the direct voltage source DC0', and the capacitors C1' and C2' are charged with the voltages $U_1'$ and $U_2'$. Moreover, in the exemplary embodiment the voltage $U_2'$ of the charged capacitor C2 is smaller than the voltage $U_1'$ of the charged capacitor C1.

For discharging the capacitors C0' through C2', the switching element S' is closed and the capacitor Co' begins to discharge via the flat coil 23, whereby a current i'(t) flows through the flat coil 23. As long as the voltage $u_0'(t)$ of the capacitor C0' is greater than the voltage $U_1'$ of the charged capacitor C1', the diodes D1' and D2' block. If the voltage $u_0'(t)$ of the capacitor C0' achieves the value of the voltage $U_1'$ of the charged capacitor C1', the diode D1' is conductive and the current i'(t) through the flat coil 23 is fed by both capacitors C0' and C1'. If the voltages $u_0'(t)$ and $u_1'(t)$ of the capacitors C0' and C1' achieve the voltage $U_2'$ of the charged capacitor C2', the diode D2' is conductive and the current i'(t) through the flat coil 23 is fed by the capacitors C0' through C2'.

Figure 7:
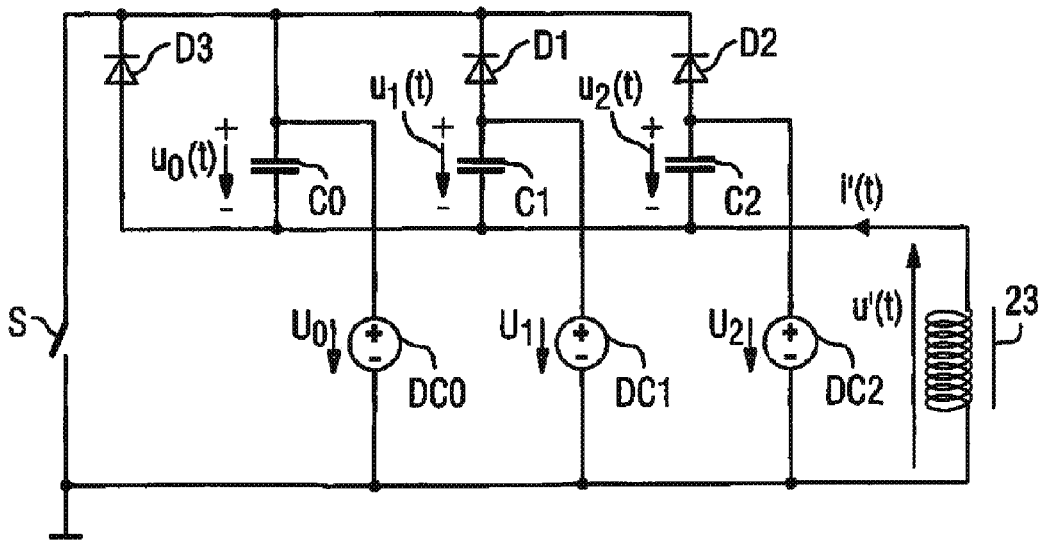

FIG. 7 shows a further inventive switching circuit that has an additional diode in comparison to the switching circuit shown in FIG. 4. The diode D3 is switched in parallel and in the blocking direction relative to the charging voltage $U_0$ of the capacitor C0.

Figure 8:
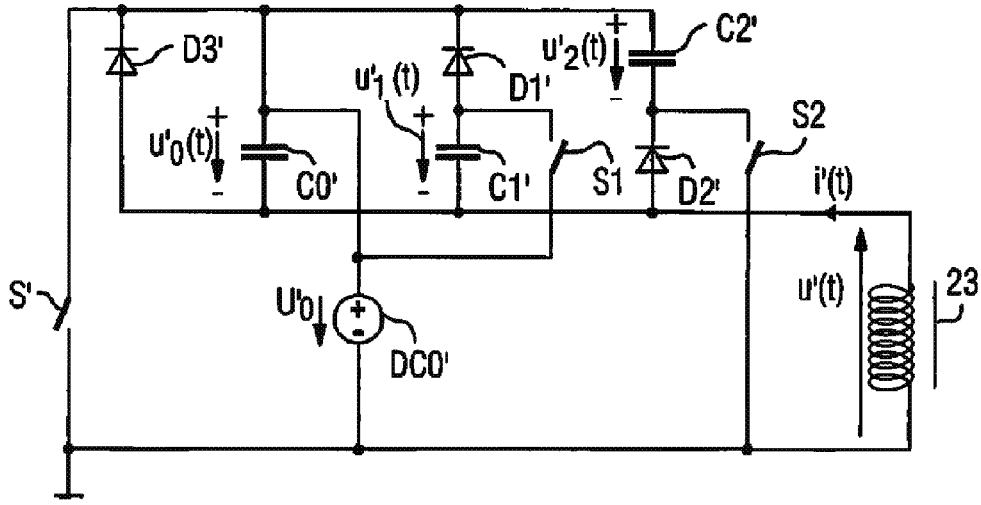

FIG. 8 shows yet another inventive switching circuit that has an additional diode D3' in comparison to the switching circuit shown in FIG. 6. The diode D3' is switched in parallel and in the blocking direction by the charging voltage $U'_0$ of the capacitor C0'.

Instead of the diodes D1 through D3 and D1' through D3', in particular diode modules composed of a series switching circuit and/or parallel switching circuit of a number of diodes can also be used. The switching elements S, S', S1 and S2 can be a series switching circuit of known thyristors that, for example, are offered by the company BEHLKE ELECTRONIC GmbH, Am Auerberg 4, 61476 Kronberg, in their catalog "Fast High Voltage Solid State Switches" of June 2001.

Although modifications and changes may be suggested by those skilled in the art, it is the invention of the inventor to embody within the patent warranted heron all changes and modifications as reasonably and properly come within the scope of his contribution to the art.

I claim:

1. A switching circuit for an electromagnetic source for generating acoustic waves, comprising:

a first capacitor connected in parallel with a series circuit composed of a second capacitor and an electronic switch;

a coil of an electromagnetic source connected to said first capacitor and to said series circuit; and first and second capacitors being dimensioned, and said electronic switch being operated, for causing, after said first and second capacitors are charged, said electronic switch to assume a blocking state during discharge of said first capacitor as long as said first capacitor is charged with a larger voltage than said second capacitor, and said electronic switch switching to a conductive state as soon as the voltage of the first capacitor, during discharge thereof, reaches substantially the voltage of said second capacitor, whereupon said second capacitor begins to discharge and said first capacitor continues to discharge, said first and second discharging capacitors feeding said coil with current.

2. A switching circuit as claimed in claim 1 wherein said electronic switch is a diode.

3. A switching circuit as claimed in claim 1 wherein said electronic switch is a diode module.

4. A switching circuit as claimed in claim 1 wherein said first capacitor is dimensioned to be charged with a greater charging voltage than said second capacitor, before discharge of said first capacitor and said second capacitor.

5. A switching circuit as claimed in claim 1 comprising a first direct voltage source connected to said first capacitor for charging said first capacitor and a second direct voltage source connected to said second capacitor for charging said second capacitor.

6. A switching circuit as claimed in claim 1 comprising a single direct voltage source connected to said first capacitor for charging said first capacitor and connected to said second capacitor for charging said second capacitor, and a switching element connected between said single direct voltage source and said second capacitor for disconnecting said second capacitor from said single direct voltage source when said second capacitor is fully charged.

7. A switching circuit as claimed in claim 6 wherein said switching element comprises at least one semiconductor element.

8. A switching circuit as claimed in claim 1 wherein said electronic switch is a first electronic switch, and comprising a series circuit composed of a second electronic switch and a third capacitor connected in parallel with said series circuit composed of said second capacitor and said first electronic switch, and a third electronic switch connected in parallel with said first capacitor.

9. A switching circuit as claimed in claim 8 wherein said second electronic switch is a diode.

10. A switching circuit as claimed in claim 8 wherein said second electronic switch is a diode module.

11. A switching circuit as claimed in claim 8 wherein said third electronic switch is a diode.

12. A switching circuit as claimed in claim 8 wherein said third electronic switch is a diode module.

13. An electromagnetic source for generating acoustic waves, comprising:

a switching circuit comprising a first capacitor connected in parallel with a series circuit composed of a second capacitor and an electronic switch, a coil of an electromagnetic source connected to said first capacitor and to said series circuit, and first and second capacitors being dimensioned, and said electronic switch being operated, for causing, after said first and second capacitors are charged, said electronic switch to assume a blocking state during discharge of said first capacitor as long as said first capacitor is charged with a larger voltage than said second capacitor, and said electronic switch switching to a conductive state as soon as the voltage of the first capacitor, during discharge thereof, reaches substantially the voltage of said second capacitor, whereupon said second capacitor begins to discharge and said first capacitor continues to discharge, said first and second discharging capacitors feeding said coil with current; and a membrane disposed adjacent said coil that is repelled by said coil dependent on said current in said coil.

14. A lithotripter comprising:

an electromagnetic source comprising a switching circuit comprising a first capacitor connected in parallel with a series circuit composed of a second capacitor and an electronic switch, a coil of an electromagnetic source connected to said first capacitor and to said series circuit, and first and second capacitors being dimensioned, and said electronic switch being operated, for causing, after said first and second capacitors are charged, said electronic switch to assume a blocking state during discharge of said first capacitor as long as said first capacitor is charged with a larger voltage than said second capacitor, and said electronic switch switching to a conductive state as soon as the voltage of the first capacitor, during discharge thereof, reaches substantially the voltage of said second capacitor, whereupon said second capacitor begins to discharge and said first capacitor continues to discharge, said first and second discharging capacitors feeding said coil with current, and a membrane disposed adjacent said coil that is repelled by said coil dependent on said current in said coil;

an acoustic lens disposed in a path of said acoustic waves for focusing said acoustic waves; and a cushion having a hollow interior filled with acoustic propagation medium through which the focused acoustic waves propagate, said cushion being adapted for placement against a subject to be treated with said focused acoustic waves.

* * * * *